US011606856B2

(12) United States Patent
Kim et al.

(10) Patent No.: US 11,606,856 B2
(45) Date of Patent: Mar. 14, 2023

(54) ELECTROMAGNETIC WAVE GENERATOR AND CONTROL METHOD THEREOF

(71) Applicants: AweXome Ray, Inc., Anyang-si (KR); Sang Soo Kim, Seoul (KR)

(72) Inventors: Sang Soo Kim, Seoul (KR); Hong Soo Choi, Seoul (KR); Se Hoon Gihm, Seongnam-si (KR)

(73) Assignee: AweXome Ray, Inc., Anyang-si (KR)

( * ) Notice: Subject to any disclaimer, the term of this patent is extended or adjusted under 35 U.S.C. 154(b) by 0 days.

(21) Appl. No.: 17/691,860

(22) Filed: Mar. 10, 2022

(65) Prior Publication Data

US 2022/0346214 A1 Oct. 27, 2022

(30) Foreign Application Priority Data

Mar. 10, 2021 (KR) ..... 10-2021-0031625

(51) Int. Cl.
*H05G 1/32* (2006.01)
*H01J 35/08* (2006.01)
(Continued)

(52) U.S. Cl.
CPC ..... *H05G 1/32* (2013.01); *H01J 35/08* (2013.01); *H05G 1/265* (2013.01); *H05G 1/34* (2013.01)

(58) Field of Classification Search
CPC ..... H05G 1/32; H05G 1/265; H05G 1/34; H05G 1/56; H05G 1/30; H05G 2/00; H05G 1/10; H05G 1/06; H01J 35/08; H01J 35/20; H01J 35/16; H01J 35/065; H01J 2235/20; H01J 2235/062; H01J 35/064; H01J 35/06; H01J 35/045; H01J 35/112; H01J 9/39; H01J 35/04; H01J 35/066; H01J 35/153; H01J 35/025; H01J 35/147; H01J 2235/168; H01J 35/305; H01J 35/26; H01J 3/021; H01J 1/304; H01J 1/46; H01J 9/148; H01J 2203/0236; H01J 2203/026; H01J 9/025; H01J 9/445; H01J 2201/30469;
(Continued)

(56) References Cited

U.S. PATENT DOCUMENTS 10,507,001 B2 12/2019 Koh et al.
10,991,539 B2 * 4/2021 Kenmotsu ..... H01J 35/153
(Continued)

FOREIGN PATENT DOCUMENTS

JP 2018-22550 A 2/2018
KR 10-0330190 B1 3/2002
(Continued)

*Primary Examiner* — Irakli Kiknadze
(74) *Attorney, Agent, or Firm* — Seed IP Law Group LLP

(57) ABSTRACT

Disclosed is an electromagnetic wave generator, comprising a tube comprising an anode, a cathode and at least one gate, a tube power supply circuit in which one side of an output terminal is connected to the anode, and the other side of the output terminal is connected to the cathode, and a gate controlling circuit in which at least one side of the output terminal is connected to the gate, wherein a first voltage value of one side of the output terminal of the tube power supply circuit and a second voltage value of the other side of the output terminal of the tube power supply circuit are different from each other with respect to a ground terminal of the tube power supply circuit.

10 Claims, 6 Drawing Sheets

(51) Int. Cl.
*H05G 1/26* (2006.01)
*H05G 1/34* (2006.01)

(58) Field of Classification Search
CPC ... A61B 6/4266; A61B 6/4283; A61B 6/4494; A61B 6/54; A61B 6/547; A61B 6/548; A61B 6/587; A61B 6/08; A61B 6/4233; A61B 6/4405; A61B 6/461; A61B 6/465; A61B 6/467; G01N 23/04; G01T 1/175; G06F 19/34
USPC ..... 378/111, 114, 119, 127, 137, 138
See application file for complete search history.

(56) References Cited

U.S. PATENT DOCUMENTS

2011/0286581 A1* 11/2011 Sprenger ..... A61B 6/4028 977/950
2015/0098551 A1 4/2015 Kwak et al.
2016/0148776 A1* 5/2016 Jeong ..... H01J 35/065 315/337
2016/0307725 A1* 10/2016 Jeong ..... H01J 35/08
2017/0135189 A1* 5/2017 Jeong ..... A61B 6/00
2017/0347438 A1* 11/2017 Kang ..... H05G 1/32
2018/0184990 A1* 7/2018 Shin ..... A61B 6/145
2021/0030388 A1* 2/2021 Hidenori ..... A61B 6/025

FOREIGN PATENT DOCUMENTS

KR 10-2009-0030531 A 3/2009
KR 10-2016-0062279 A 6/2016
KR 10-2017-0115018 A 10/2017
KR 10-2018-0007422 A 1/2018
KR 10-2018-0024017 A 3/2018
KR 10-2020-0111513 A 9/2020
WO 2019/151251 A1 8/2019
WO WO-2019151251 A1 * 8/2019

* cited by examiner

ELECTROMAGNETIC WAVE GENERATOR AND CONTROL METHOD THEREOF

BACKGROUND

Technical Field

The present disclosure relates to an electromagnetic wave generator and a control method thereof. More specifically, example embodiments of the present disclosure relate to any electromagnetic wave generator capable of generating extreme ultraviolet (EUV) and X-rays. Especially, the present disclosure relates to an electromagnetic wave generator for increasing the stability and efficiency of a gate and a method for controlling the same.

Description of the Related Art

Electromagnetic waves are waves created by changes in electric and magnetic fields, and include gamma rays, X-rays, ultraviolet rays, visible rays, infrared rays and radio waves, and are widely used in various fields. For example, ultraviolet rays are for sterilization, infrared rays are used for heating, remote control, etc. In addition, electromagnetic waves are used in various places such as microwave ovens using microwaves, and TVs, radios and mobile phones using radio waves. Among them, X-rays and gamma rays are wavelengths used for X-ray photography or radiation therapy, and radiography equipment, which is a type of electromagnetic wave generator, is being used to image the internal shape of an object using X-rays, gamma rays or similar ionizing radiation and non-ionizing radiation. Such a radiographic apparatus includes a medical radiographic apparatus and an industrial radiographic apparatus. For example, medical radiographic apparatuses include dental X-ray imaging devices and computed tomography (CT) apparatuses.

The quality of an image generated by an X-ray imaging device among radiographic imaging devices is related to the voltage between the anode and the cathode in an X-ray tube (or the current flowing between the anode and the cathode, hereinafter referred to as Iac). Because general X-ray systems use high voltage, most X-ray systems are prone to error and image artifacts caused by inaccurate tube voltage. Further, due to the high voltage, the insulation voltage that a gate has to burden may be higher than the cathode voltage. This makes the insulation design difficult and the overall structure complicated, which may reduce the stability of the X-ray tube and the efficiency of an electromagnetic wave generator.

BRIEF SUMMARY

Example embodiments of the present disclosure are proposed to solve the above-described problems. Since the magnitude of the current flowing through the tube is constant and the ratio of the voltage value supplied to the anode and the voltage value supplied to the cathode is different, the efficiency of insulation borne by the gate power supply may be increased.

Further, since the example embodiments of the present disclosure may adjust the voltage supplied to the gate based on the Iac current value, it is possible to control the constant current so that the current flowing through the tube is stable without the need to directly sense the voltage applied between the gate and the cathode.

The technical problems to be solved by the example embodiments of the present disclosure are not limited to the technical problems described above, and other technical problems may be inferred from the following the example embodiments.

According to an aspect, there is provided an electromagnetic wave generator, comprising a tube comprising an anode, a cathode and at least one gate, a tube power supply circuit in which one side of an output terminal of the tube power supply is connected to the anode, and the other side of the output terminal of the tube power supply is connected to the cathode, and a gate controlling circuit in which at least one side of an output terminal of the gate controlling circuit is connected to the gate, wherein a first voltage value of one side of the output terminal of the tube power supply circuit and a second voltage value of the other side of the output terminal of the tube power supply circuit are different from each other with respect to a ground terminal of the tube power supply circuit.

According to another aspect, there is also provided a method of controlling an electromagnetic wave generator, wherein the electromagnetic wave generator comprises a tube comprising an anode, a cathode and at least one gate, a first booster circuit in which one side of an output terminal of the first booster circuit is connected to the anode and a second booster circuit in which one side of an output terminal of the second booster circuit is connected to the cathode, the method including controlling the first booster circuit and the second booster circuit such that a first voltage value of one side of the output terminal of the first booster circuit is different from a second voltage value of one side of the output terminal of the second booster circuit, sensing a current output from the other side of the output terminal of the second booster circuit to a ground terminal, and controlling a gate voltage supplied to the gate based on sensed information on the current.

According to the example embodiments, provided is an electromagnetic wave generator that increases the efficiency of the isolation borne by the gate power supply by reducing the gate insulation voltage by varying the ratio of the voltage value supplied to the anode to the voltage value supplied to the cathode.

Further, according to the example embodiments, provided is an electronic wave generator that controls the constant current to keep the current flowing through the tube constant by controlling the voltage supplied to the gate and increases the stability of the tube.

Especially, the example embodiments of the present disclosure are usefully applicable to a cathode type X-ray tube composed of a carbon nanotube (CNT) capable of controlling a fine current. Further, the example embodiments are applicable to portable electromagnetic wave generators in addition to installed or stationary electromagnetic wave generators.

The effects of the present disclosure are not limited to the effects described above, and other effects not described would be clearly understood by those skilled in the art from the description of the claims.

BRIEF DESCRIPTION OF THE SEVERAL VIEWS FO THE DRAWINGS

DETAILED DESCRIPTION

Figure 1A:
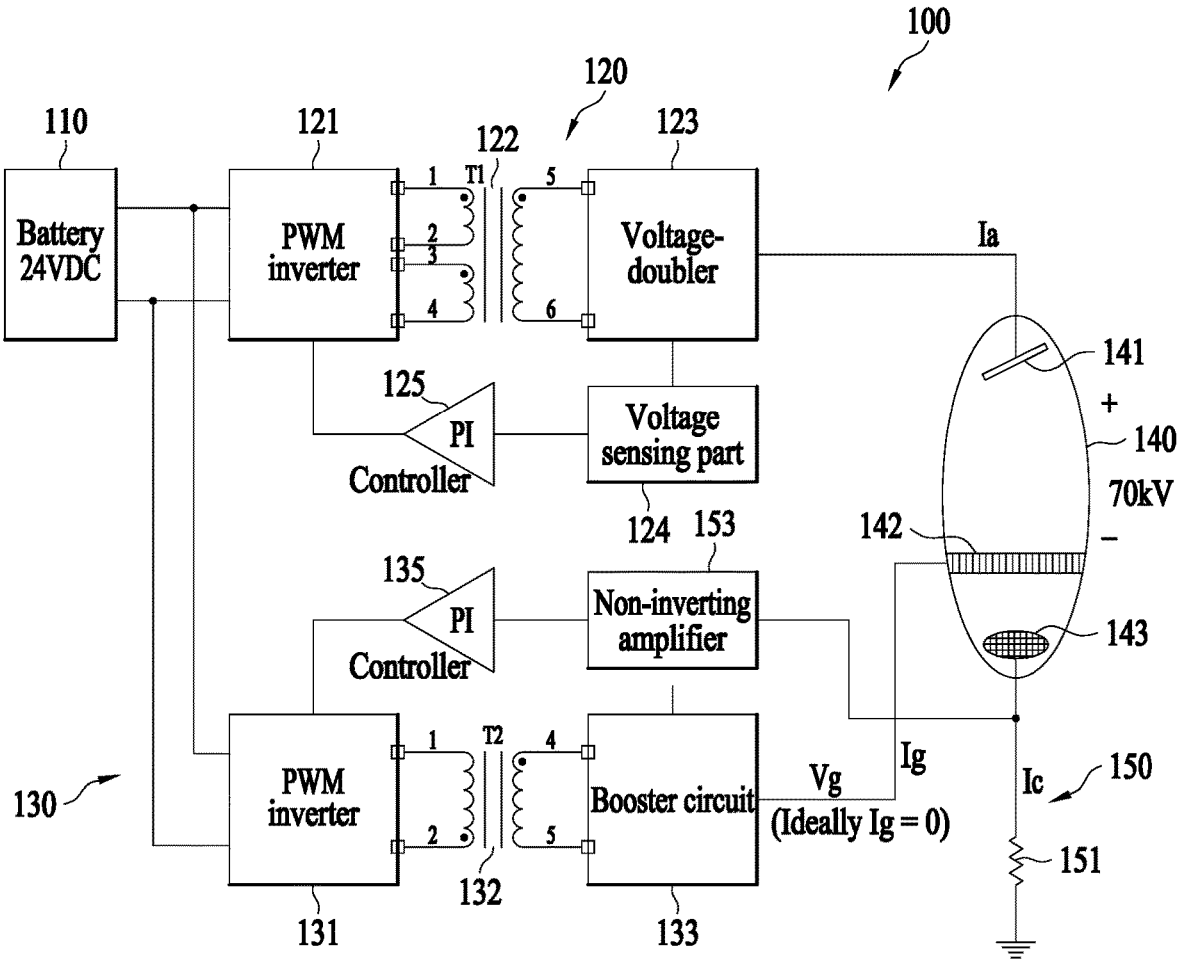
FIGS. 1A, 1B are block diagrams for explaining constitutions of an electronic wave generator and a current sensing method.

Terms used in the example embodiments are selected as currently widely used general terms as possible while considering the functions in the present disclosure. However, the terms may vary depending on the intention or precedent of a person skilled in the art, the emergence of new technology, and the like. Further, in certain cases, there are also terms arbitrarily selected by the applicant, and in the cases, the meaning will be described in detail in the corresponding descriptions. Therefore, the terms used in the present disclosure should be defined based on the meaning of the terms and the contents of the present disclosure, rather than the simple names of the terms.

In the following drawings, the thickness or size of each layer is exaggerated for convenience and clarity of description, and in the drawings, like reference numerals refer to like elements. As used in the present disclosure, the term "and/or" includes any one and all combinations of one or more of those listed items. For example, the expression "at least one of a, b and c" described throughout the specification may include "a alone," "b alone," "c alone," "a and b," "a and c," "b and c" or "all of a, b and c." Further, in the present disclosure, "connected" indicates not only when member A and member B are directly connected, but also when member A and member B are indirectly connected by interposing member C between member A and member B.

As used in the present disclosure, a singular form may include a plural form unless the context clearly indicates otherwise. Further, in the entire present disclosure, when a part "includes" a certain component, it indicates that other components may be further included, rather than excluding other components, unless otherwise stated. Terms such as " . . . unit," " . . . group," and " . . . module" described in the present disclosure mean a unit that processes at least one function or operation, which may be implemented as hardware, software, or a combination thereof.

In the present disclosure, the terms first, second, etc., are used to describe various members, components, regions, layers and/or portions. However, it is to be understood that the members, components, regions, layers and/or portions should not be limited by the terms. The terms are used only to distinguish one member, component, region, layer or portion from another member, component, region, layer or portion. Therefore, a first member, a first component, a first region, a first layer or a first portion to be described below may refer to a second member, a second component, a second region, a second layer or a second portion, without departing from the description of the present disclosure.

Hereinafter, the example embodiments of the present disclosure will be described in detail with reference to the accompanying drawings so that those of ordinary skill in the art to which the present disclosure pertains may easily implement them. However, the present disclosure may be implemented in multiple different forms and is not limited to the example embodiments described herein. Hereinafter, the example embodiments of the present disclosure will be described in detail with reference to the drawings.

Figure 1B:
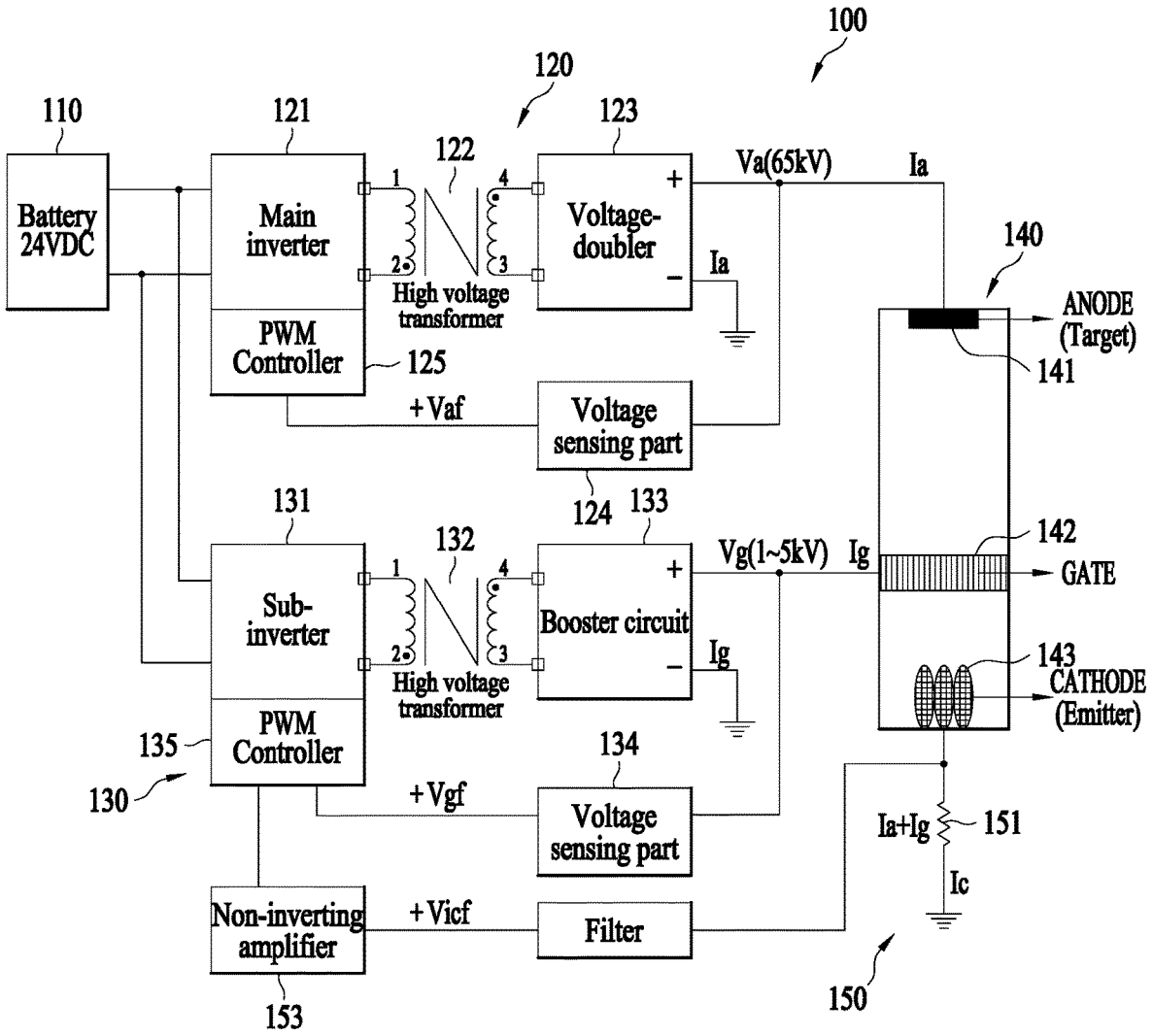

FIGS. 1A, 1B are block diagrams for explaining constitutions of an electronic wave generator 100 and a current sensing method.

As illustrated in FIG. 1A, the electronic wave generator 100 may include a power source 110, an anode power supply circuit 120, a gate power supply circuit 130, a tube 140 and a current sensing circuit 150.

The power source 110 may supply the direct current or alternating current to each of the anode power supply circuit 120 and the gate power supply circuit 130. In some example embodiments, the power source 110 may include a battery such as a lithium ion battery, a lithium polymer battery or a lithium solid-state battery.

The anode power supply circuit 120 may be electrically connected to the power source 110 to supply, for example, high-pressure anode direct current power to an anode 141 provided in the tube 140. In some example embodiments, the anode power supply circuit 120 may supply direct current power of approximately 50 to 70 kV to the anode 141 of the tube 140. Further, in some example embodiments, the anode power supply circuit 120 may include a pulse width modulation (PWM) inverter 121, a high voltage transformer 122 and a booster circuit 123 (a voltage-multiplier or a smoothing circuit). In addition, the anode power supply circuit 120 may further include a voltage sensing part 124 and a proportional integral controller (a PWM controller) 125. Further in an example embodiment, the tube is described with reference to, but not limited to, an X-ray tube, and example embodiments of the present disclosure may be applied to tubes that may be used in electromagnetic wave generators as well.

In this way, the PWM inverter 121 connected to the power source 110 converts the input power into high-frequency alternating current power and outputs it. Further, the alternating current power is boosted by the high voltage transformer 122, so that the high-voltage direct current power may be applied to the anode 141 of the tube 140 by the booster circuit 123. At this time, the output voltage of the booster circuit 123 may be sensed by the voltage sensing part 124, and based on a sensed value, the proportional integral controller 125 may provide a PWM signal (a PWM signal whose duty rate is adjusted) to the PWM inverter 121. Accordingly, the direct current power of a constant level may be always supplied to the anode 141 of the tube 140 through the booster circuit 123. Here, the tube 140 may be an X-ray tube, and the current supplied to the anode 141 of the tube 140 may be defined as Ia. Meanwhile, in an example embodiment, an operation of the PWM inverter may be controlled based on the PWM signal whose duty rate is adjusted, and power supplied to at least one of the nodes of the tube 140 may be controlled accordingly.

The gate power supply circuit 130 may be electrically connected to the power source 110 to supply gate direct current power to a gate 142 provided in the tube 140. In some example embodiments, the gate power supply circuit 130 may supply direct current power of approximately 1 to 5 kV to the gate 142 of the tube 140. Here, a cathode 143 of the tube 140 may be connected to a current sensing resistor 151. Further, in some example embodiments, the gate power supply circuit 130 may include a PWM inverter 131, a high voltage transformer 132 and a booster circuit 133 (a voltage-multiplier or a smoothing circuit).

In this way, the PWM inverter 131 connected to the power source 110 converts direct current power into alternating current power and outputs it. In addition, the alternating current power is boosted by the high voltage transformer 132, so that the high-voltage direct current power may be supplied to the gate 142 of the tube 140 by the booster circuit 133. Here, the tube 140 may be an X-ray tube, the voltage applied to the gate 142 of the tube 140 may be defined as Vg, and the gate current may be defined as Ig.

The tube 140 may include the anode 141, the gate 142 and the cathode 143. The anode power supply circuit 120 may be connected to the anode 141, and each of the gate power supply circuit 130 and the current sensing resistor 151 may be connected to each of the gate 142 and the cathode 143. The gate 142 may be a gate of any one of a grid structure, a wire structure and a pin-hole structure. In addition, the gate 142 may be formed of one or more wires and one or more empty spaces. In the tube 140, the gate 142 may be one or a multi-gate consisting of several gates.

The current sensing circuit 150 may be connected to the cathode 143 of the tube 140, and a current value flowing between the anode 141 and the cathode 143 of the tube 40 may be sensed and provided to the gate power supply circuit 130.

Here, the current sensing circuit 150 may include the current sensing resistor 151 connected between the cathode 143 of the tube 140 and a ground terminal and a non-inverting amplifier 153 connected to the current sensing resistor 151. The non-inverting amplifier 153 may be connected to a proportional integral controller 135 of the gate power supply circuit 130. In addition, the current flowing through the current sensing resistor 151 may be defined as Ic.

In this way, the current Ic may be sensed by the current sensing circuit 150 and the sensed value may be amplified by the non-inverting amplifier 153. In addition, based on an amplified value, the proportional integral controller 135 may provide a PWM signal (a PWM signal whose duty rate is adjusted) to the PWM inverter 131. As a result, direct current power of a predetermined level (changed level) may be supplied to the gate 142 of the tube 140 through the booster circuit. That is, the current flowing through the tube 140 may be proportionally controlled by the voltage Vg by the gate power supply circuit 130. Here, as the current Ia flowing through the tube 140 increases, the amount of electromagnetic waves increases.

Meanwhile, the PWM inverter 121 of the anode power supply circuit 120 in FIG. 1A may be represented by a main inverter 121 and the PWM controller 125 as illustrated in FIG. 1B, and the PWM inverter 131 of the gate power supply circuit 130 in FIG. 1B may be represented by a sub-inverter 131 and a PWM controller 135 as illustrated in FIG. 1B.

Here, a voltage applied to the gate 142 by the booster circuit 133 of the gate power supply circuit 130 may be sensed by a voltage sensing part 134 and provided to the PWM controller 135, and the current flowing through the current sensing resistor 151 of the current sensing circuit 150 may be converted into a voltage value, pass through a filter, and be provided to the PWM controller 135 through the non-inverting amplifier 153.

Figure 2:
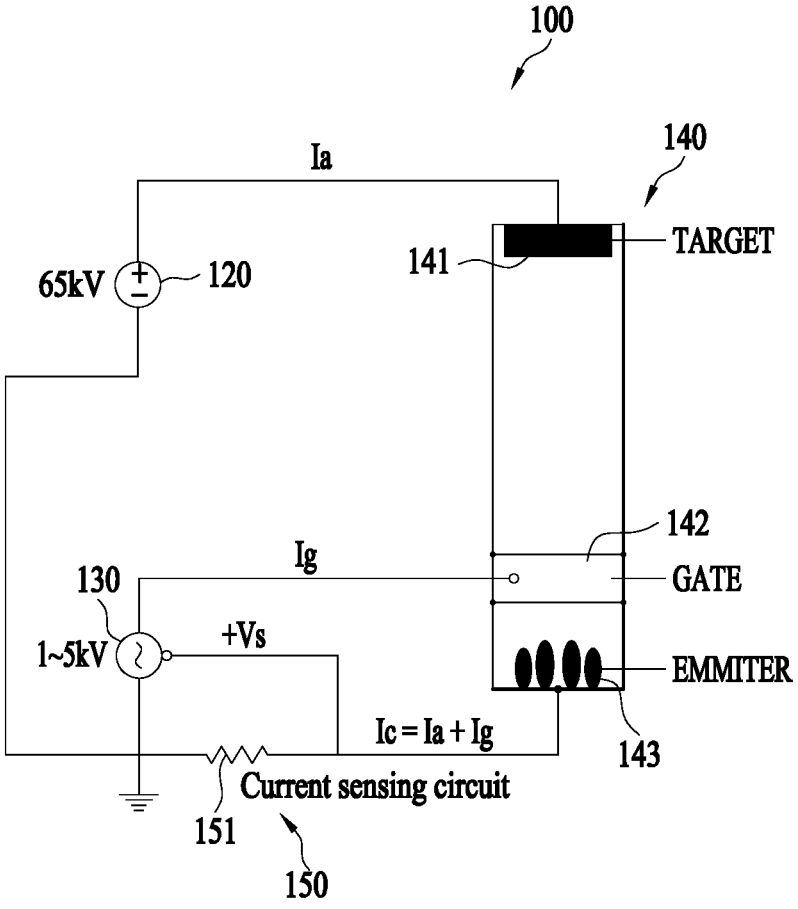
FIG. 2 is a block diagram for explaining constitutions of an electronic wave generator and a current sensing method.

FIG. 2 is a block diagram for explaining constitutions of an electronic wave generator and a current sensing method.

Further, as illustrated in FIG. 2, the current flowing through current sensing resistor 151 of the current sensing circuit 150 is Ic, and may be a current value satisfying the formula Ic=Ia+Ig. Ig is a leakage current and may have a negative value in the above equation, and ideally, the closer Ig to 0, the closer Ic may be to Ia.

Figure 3:
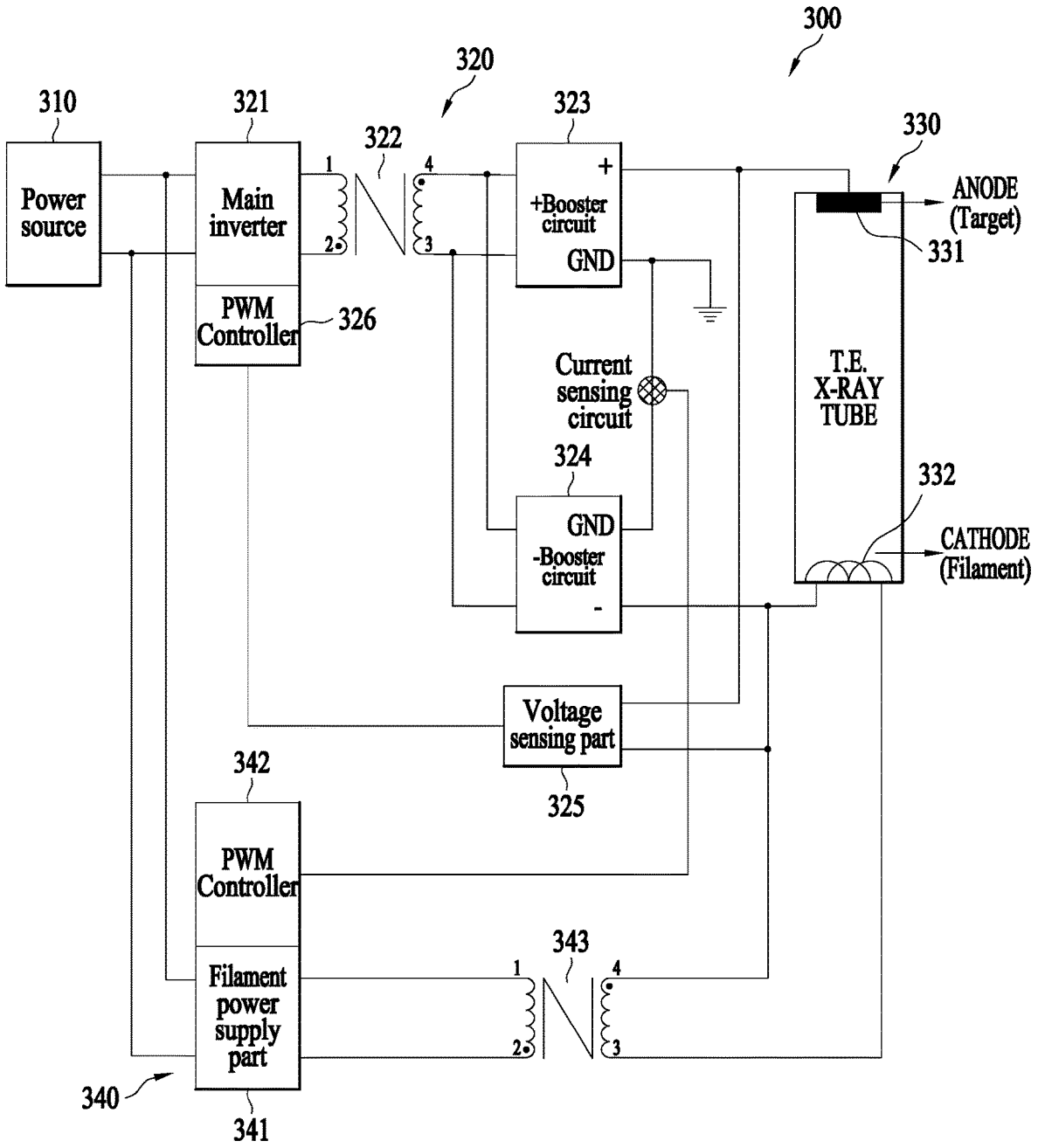
FIG. 3 is a block diagram for explaining a constitution of an electromagnetic wave generator using a thermionic emission (TE) tube.

FIG. 3 is a block diagram for explaining a constitution of an electromagnetic wave generator using a TE tube.

The TE tube consists of a cathode made of a metal filament and an anode, which is a metal target, and the TE tube uses the principle that electrons are emitted from the heated metal filament (the anode). The metal filament is heated above 1000° C. and emits electrons, and the electrons are accelerated by an applied electric filed and collide with a metal target to generate electromagnetic waves.

In order to heat the metal filament to a high temperature, it is common for the TE tube to apply a high voltage between the anode and the cathode. In general, when a constant voltage is supplied to the anode, the voltage supplied to the cathode may have a phase opposite to the voltage applied to the anode and a voltage having the same value may be supplied. For example, if a voltage +50 kV is supplied to the anode, a voltage of −50 kV may be supplied to the cathode.

Referring to FIG. 3, an electromagnetic wave generator 300 using a TE tube 330 may include a power source 310, a tube power supply circuit 320, the TE tube 330 and a filament power supply circuit 340.

The power source 310 may supply the direct current or alternating current to each of the tube power supply circuit 320 and the filament power supply circuit 340. In some example embodiments, the power source 310 may include a battery such as a lithium ion battery, a lithium polymer battery or a lithium solid-state battery.

The tube power supply circuit 320 may be electrically connected to the power source 310 to supply high-pressure direct current power to an anode 331 provided in the TE tube 330. In some example embodiments, the tube power supply circuit 320 may include a PWM inverter 321, a high voltage transformer 322 and booster circuits 323 and 324 (voltage-multipliers or smoothing circuits). Further, the tube power supply circuit 320 may further include a voltage sensing part 325 and a proportional integral controller (a PWM controller) 326.

According to an example embodiment, the PWM inverter 321 connected to the power source 310 converts the input power into high-frequency alternating current power and outputs it, and the alternating current power may be boosted through the high voltage transformer 322. In addition, a high-pressure direct current power may be applied to the anode 331 of the TE tube 330 by the first booster circuit 323. Further, the boosted alternating current power may be applied to a cathode 332 of the TE tube 330 as high-pressure direct current power by the second booster circuit 324. At this time, the output voltage of the first booster circuit 323 and the output voltage of the second booster circuit 324 are sensed by the voltage sensing part 325, and based on a sensed value, a power supply part 341 may be controlled, which indicates that the power supply part 341 may be controlled based on an on/off duty rate through a PWM signal. The use of the PWM controller is an example for convenience of description, and various modifications of the power supply capable of correspondingly adjusting the power supply based on the sensed current may be applied. As described above, in an example embodiment, the proportional integral controller 326 may provide a PWM signal (a PWM signal whose duty rate is adjusted) to the PWM inverter 321. As a result, direct current power at a constant level may be supplied to the anode 331 of the TE tube 330 through the first booster circuit 323, and the direct current power at a constant level may be supplied to the cathode 332 of the TE tube 330 through the second booster circuit 324. Electrons in the TE tube 330 due to the difference between the voltage applied to the anode 331 by the first booster circuit 323 and the voltage applied to the cathode 332 by the second booster circuit 324 may be accelerated. As a result, electromagnetic waves are generated. For example, electromagnetic waves may be generated when accelerated electrons collide with a target.

The filament power supply circuit 340 supplies power to heat the filament in order to emit electrons from the cathode 332. The filament power supply circuit 340 may include the power supply part 341, a proportional integral controller (a PWM controller) 342 and an insulation transformer 343. In an example embodiment, the power supply part 341 connected to the power source 310 may convert the input power into high-frequency alternating current power and output the converted power, and the high-frequency alternating current power may be insulated through the insulation transformer 343 and applied to the filament of the cathode 332. At this time, based on the sensed information of the anode current monitored from the second booster circuit 324, the proportional integral controller 342 may provide a PWM signal (a PWM signal whose duty rate is adjusted) to the power supply part 341.

Meanwhile, the TE tube has a limitation in that the response time is long because it must be heated to a high temperature in order to emit electrons from the metal filament. Further, the wide energy distribution of the electrons emitted from the heated cathode makes it difficult to focus and may impair the imaging resolution of electromagnetic waves. In addition, the typical lifespan of a TE tube is often less than one year, as high temperatures may cause the filament material to evaporate or oxidation by residual gases may shorten the lifespan, and most of the other tube failure causes are filament related.

A field emission (FE) tube may be considered in order to have a lifespan longer than the TE tubes and to increase reliability. The FE tube has the advantage that electrons are emitted from the metal cathode by an applied electric field, but the temperature of the emitter is much lower than that of the filament of the TE tube. Because the cathode temperature is lower, the FE tube has a longer lifespan and is more responsive than the TE tube. In addition, the FE tube may fine-tune the voltage control between the electrodes, so it is easy to control the FE tube to emit the required level of electromagnetic waves accordingly.

As such a FE tube, a CNT tube using a CNT emitter may be used.

The CNT tube may include a gate to induce the emission of electrons, and a high voltage is applied to the tube to provide a magnetic field strong enough to emit electrons from the cathode. However, due to the high voltage, a leakage current may occur in the gate, and the insulation voltage that the gate must burden increases.

Due to the characteristics of the CNT tube containing such a gate, the CNT tube may have an insulation design above the cathode voltage. However, since the cathode voltage is a high voltage, there are problems in that insulation design is difficult, circuit is complicated and product reliability is reduced. In order to solve the problem, for example, the structure of a TE tube may be applied to a CNT tube.

Figure 4:
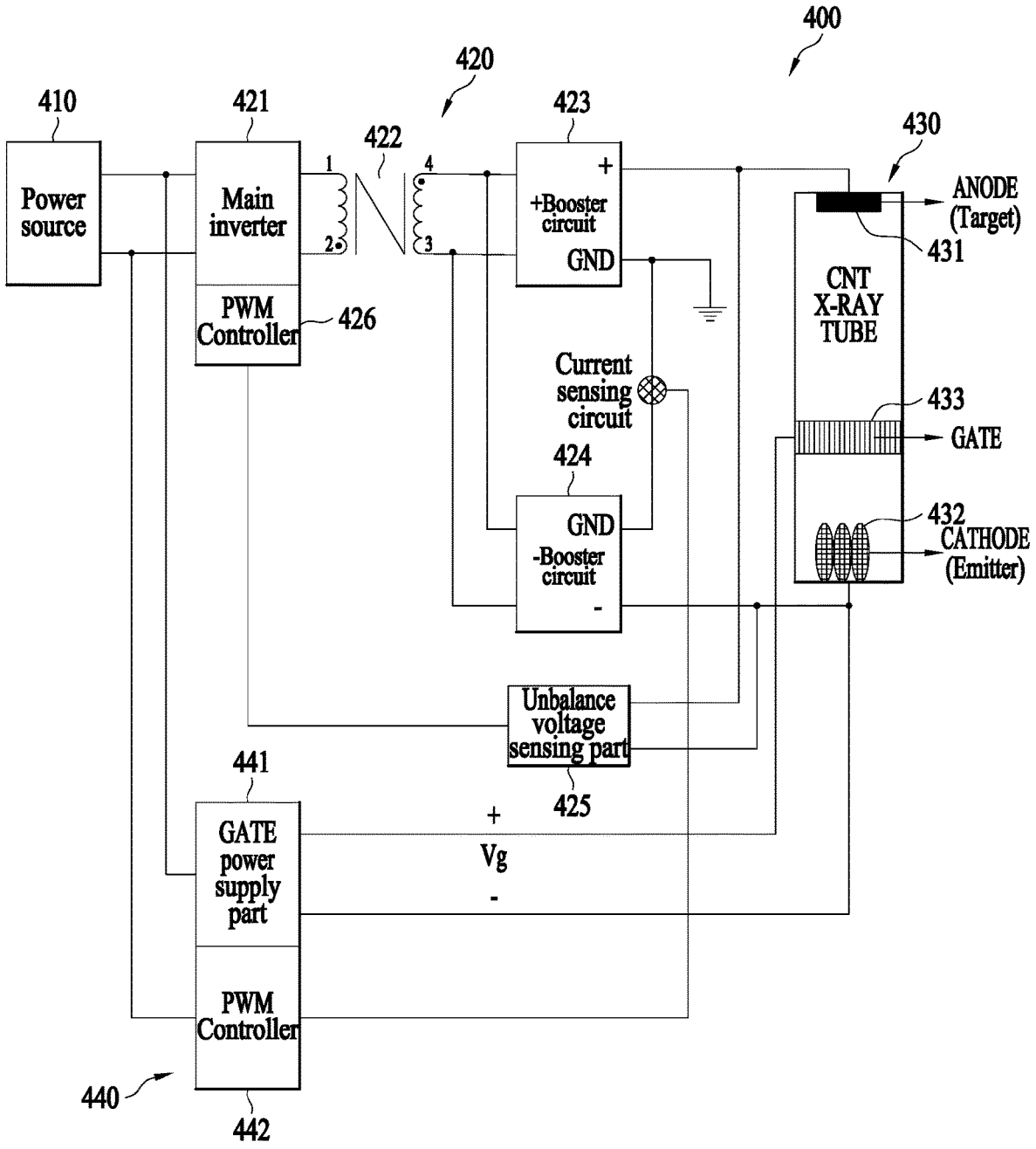
FIG. 4 is a block diagram illustrating a constitution of an electromagnetic wave generator and a method of supplying an unbalanced voltage according to an example embodiment of the present disclosure.

FIG. 4 is a block diagram illustrating a constitution of an electromagnetic wave generator and a method of supplying an unbalanced voltage according to an example embodiment of the present disclosure.

Referring to FIG. 4, an electromagnetic wave generator 400 may include a power source 410, a tube power supply circuit 420, an electromagnetic wave tube 430 and a gate controlling circuit 440. Further, the electromagnetic wave tube 430 may include an anode 431, a cathode 432 and at least one gate 433. In this case, the gate 433 may be a gate of any one of a grid structure, a wire structure and a pin-hole structure, and the cathode 432 may be made of a CNT.

The power source 410 may supply the direct current or alternating current to each of the tube power supply circuit 420 and the gate controlling circuit 440. In some example embodiments, the power source 410 may include a battery such as a lithium ion battery, a lithium polymer battery or a lithium solid-state battery.

In the tube power supply circuit 420, one side of an output terminal may be connected to the anode 431, and the other side of the output terminal may be connected to the cathode 432. Further, the tube power supply circuit 420 may be electrically connected to the power source 410 to supply high-voltage direct current power to the anode 431. In some example embodiments, the tube power supply circuit 420 may include a PWM inverter 421, a high voltage transformer 422 and booster circuits 423 and 424 (voltage-multipliers or smoothing circuits). Further, the tube power supply circuit 420 may further include a voltage sensing part 425 and a proportional integral controller (a PWM controller) 426. Meanwhile, as described above, the proportional integral controller is illustrated for an example, and a gate power supply circuit 441 may be controlled based on information of at least a portion of current and voltage measured at the gate and the cathode.

According to an example embodiment, the PWM inverter 421 connected to the power source 410 may convert the input power into high-frequency alternating current power and output it, and the alternating current power may be boosted through a high voltage transformer 422. In addition, a high-pressure direct current may be applied to the anode 431 of the tube 430 by the first booster circuit 423. Further, the boosted alternating current power may be applied to the cathode 432 of the tube 430 as a high-pressure direct current power by the second booster circuit 424. In this case, the output voltage of the first booster circuit 423 and the output voltage of the second booster circuit 424 may be sensed by the voltage sensing part 425, and based on a sensed value, a proportional integral controller 426 may provide a PWM signal (a PWM signal whose duty rate is adjusted) to the PWM inverter 421. As a result, the direct current power at a constant level may be supplied to the anode 431 of the tube 430 through the first booster circuit 423, and the direct current power at a constant level may be supplied to the cathode 432 of the tube 430 through the second booster circuit 424.

According to an example embodiment, one side of the output terminal of the first booster circuit 423 may be connected to the anode 431 and the other side may be connected to a ground terminal. In addition, one side of the output terminal of the second booster circuit 424 may be connected to the cathode 432, and the other side may be connected to a ground terminal together with the first booster circuit 423. Further, the first booster circuit 423 and the second booster circuit 424 may be associated with the same inverter 421, but may be respectively connected to individual inverters. That is, each of the first booster circuit 423 and the second booster circuit 424 may be connected to different inverters and transformers.

The voltage sensing part 425 may include a first voltage sensing circuit (not illustrated) for sensing a voltage at a node between the tube power supply circuit 420 and the anode 431 of the tube 430 and a second voltage sensing circuit (not illustrated) for sensing a voltage of a node between the tube power supply circuit 420 and the cathode 432 of the tube 430. That is, the voltage sensing part 425 may sense the output voltage of the first booster circuit 423 and the output voltage of the second booster circuit 424. Thus, the voltage sensing part 425 may sense an anode voltage and a cathode voltage. Further, in order to transmit a sensed value to the proportional integral controller 426 so that a constant current may flow in the anode 431 and the cathode 432, a voltage output from the tube power supply circuit 420 to the anode 431 and the cathode 432 may be controlled through the PWM inverter 421.

According to an example embodiment, based on a ground terminal of the tube power supply circuit 420, a first voltage value on one side of the output terminal of the tube power supply circuit and a second voltage value of the other side of the output terminal of the tube power supply circuit 420 may be different from each other. The first voltage value may be a positive value and the second voltage value may be a negative value. An absolute value of the first voltage value may be twice or more than twice an absolute value of the second voltage value. In a conventional TE tube, it is common that the anode voltage and the cathode voltage have symmetrical values, that is, the same absolute value. For example, in conventional TE tubes, it is common that when a voltage value supplied to the anode is +50 kV, a voltage value supplied to the cathode is −50 kV. Accordingly, if the electric potential difference between the anode and the cathode is 100 kV, in an electromagnetic wave generator according to an example embodiment of the present disclosure, the anode voltage value and the cathode voltage value may be set to asymmetric values. For example, the electromagnetic wave generator may be set so that the first voltage value is +80 kV and the second voltage value is −20 kV, and the voltage values are asymmetric with the electric potential difference between the anode and the cathode 100 kV. In another example, just as the first voltage value is +60 kV and the second voltage value is −40 kV, an absolute value of the anode voltage may be set to be greater than an absolute value of the cathode voltage with the electric potential difference between the anode and the cathode 100 kV. The asymmetry ratio may be set to an optimal ratio according to characteristics of each system when designing an electromagnetic wave generating system and the asymmetry ratio is not limited to a specific value. Further, in an example embodiment, an absolute value of a first voltage value with respect to a ground may be twice or more than twice an absolute value of a second voltage value with respect to the ground, and may have a value of 3 to 5 times. The second voltage value with respect to the ground may be twice or more than twice of the absolute value of the gate voltage value with respect to the ground, and may have a value of 3 to 5 times. According to an example embodiment, since the asymmetry ratio may be set to multiples of other real numbers in addition to the 3 to 5 times, the asymmetry ratio is not limited to the multiples which are described for the example embodiment.

Meanwhile, due to the characteristics of the electromagnetic wave tube, emitted electrons move due to the electric potential difference between the anode and the cathode. However, since the temperature of the emitter is lower than that of the TE tube, it may be difficult to emit electrons from the cathode. The gate is to aid in electron emission from the emitter, and thus, the electromagnetic wave generator 400 according to the example embodiments of the present disclosure may supply power to the gate 433 of the tube 430 through the gate controlling circuit 440.

The gate controlling circuit 440 may include the gate power supply circuit 441 and a PWM controlling circuit 442 for controlling the gate power supply circuit 441. In addition, one side of the output terminal of the gate power supply circuit 441 may be connected to the gate 433 of the tube 430, and the other side of the output terminal of the gate power supply circuit 441 may be connected to the cathode 432 of the tube 430. According to an example embodiment, the gate power supply circuit 441 may include an insulation transformer (not illustrated). The gate power supply circuit 441 may convert the input power to high-frequency alternating current power and output it, and the high-frequency alternating current power may be insulated through an insulation transformer and applied to the cathode 432. The PWM controlling circuit 442 may sense a current flowing between an output terminal of the second booster circuit 424 and a ground terminal in order to sense the cathode current. According to an example embodiment, when the leakage current generated in the gate 433 converges to zero, a value of the current flowing through the cathode 432 may be the same as a value of the current flowing through the anode 431. Based on sensed information of the cathode current (or anode current) sensed from the second booster circuit 424, the PWM controlling circuit 442 may provide a PWM signal (a PWM signal whose duty rate is adjusted) to the gate power supply circuit 441.

Meanwhile, conventionally, since a high voltage is applied to the anode and the cathode, the insulation voltage that the gate must burden is relatively high. For example, when the voltage of +50 kV is supplied to the anode, the voltage of −50 kV is supplied to the cathode, and the voltage supplied to the gate is 0 to 5 kV, the insulation voltage that the gate must burden becomes −50 kV. Accordingly, there is a problem in that a large amount of leakage current is generated or the insulation efficiency of the gate power supply deteriorates.

According to an example embodiment of the present disclosure, by supplying asymmetric voltages to the anode 431 and the cathode 432, a relatively low voltage may be applied to the cathode 432. Accordingly, the insulation voltage that the gate 433 has to burden may be lowered. For example, when the voltage of +80 kV is applied to the anode 431, the voltage of −20 kV is supplied to the cathode 432 and the voltage supplied to the gate 433 is 0 to 5 kV, the insulation voltage that the gate 433 has to burden may be −20 kV. Due to this, the leakage current in the tube 430 may be reduced and the dielectric strength applied to the insulation transformer of the gate power supply circuit 441 may be reduced, so that the stability and efficiency of the device may be increased.

To this end, the gate power supply circuit 441 may be a circuit for supplying differential output power. Alternatively, the gate power supply circuit 441 may supply a voltage in the form of a +/−Vg value. To this end, the gate power supply circuit 441 may connect the positive terminal of the output terminal to the gate 433 and the negative terminal to the cathode 432. Further, a voltage value supplied from the gate power supply circuit 441 to the gate 433 may be the positive potential value of Vg, a voltage value supplied from the gate power supply circuit 441 to the cathode 432 may be the negative potential value of Vg, and the difference between the voltage values may be a Vg value. For example, a voltage of the positive potential of Vg may be applied to the gate 433, and a voltage of the negative potential of Vg may be applied to the cathode 432. Therefore, the gate voltage between the gate 433 and the cathode 432 may have a value of 0 to 5 kV. If the negative terminal of the output terminal of the gate power supply circuit 441 is connected to the ground terminal instead of the cathode 432, the voltage between the gate 433 and the cathode 432 becomes a value obtained by adding an absolute value of the cathode voltage to +Vg, so that dielectric breakdown of the gate 433 may occur due to an excessive voltage.

According to an example embodiment, the gate controlling circuit 440 may sense the cathode current through the PWM controlling circuit 442 and control the gate voltage based on the cathode current. A value of the anode current intended for the tube 430 may be known through a voltage value supplied from the first booster circuit 423 to the anode 431 of the tube 430, and a value of the cathode current actually flowing from the tube 430 may be known through the PWM controlling circuit 442 connected to a node between the second booster circuit 424 and the ground terminal. By adjusting the gate voltage, the gate controlling circuit 440 may control the current flowing in the tube 430, without the need to directly sense the gate voltage as in a conventional electromagnetic wave generator. If the leakage current (or, the gate current) converges to 0 due to the adjustment of the gate voltage, the cathode current value will converge to the anode current value.

Figure 5:
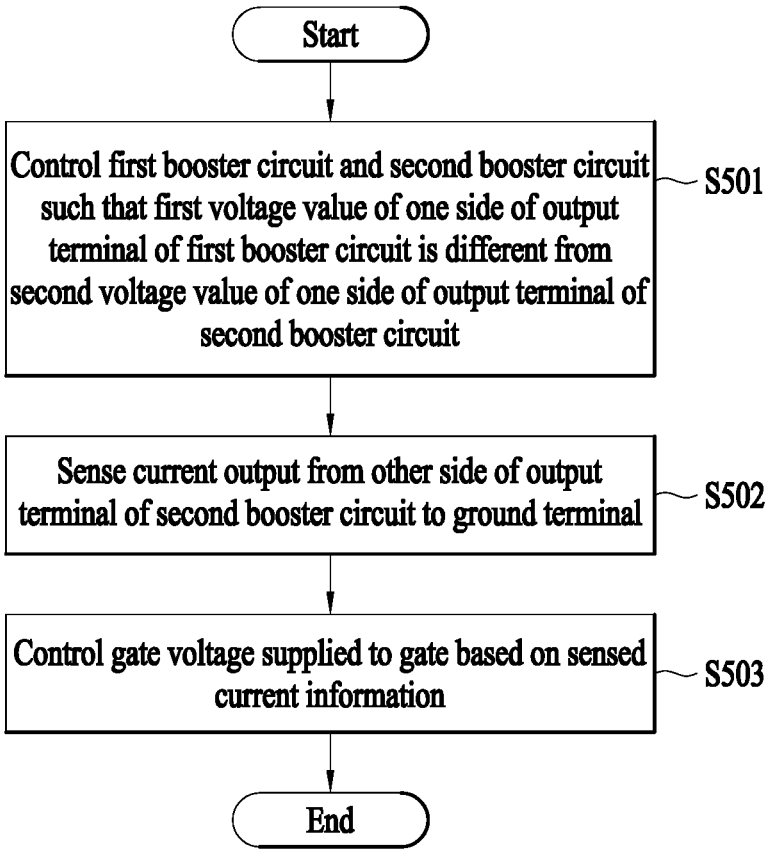
FIG. 5 is a flowchart illustrating a control method of an electromagnetic wave generator according to an example embodiment of the present disclosure.

FIG. 5 is a flowchart illustrating a control method of an electromagnetic wave generator according to an example embodiment of the present disclosure.

The device of the present disclosure may control a tube power supply circuit such that a first voltage value of one side of an output terminal of a first booster circuit is different from a second voltage value of one side of an output terminal of the second booster circuit in operation S501. One side of the output terminal of the first booster circuit may be connected to an anode of a tube, and one side of the output terminal of the second booster circuit may be connected to a cathode of the tube. Accordingly, the first voltage value may correspond to a voltage value of the anode, and the second voltage value may correspond to a voltage value of the cathode. According to an example embodiment, the first voltage value and the second voltage value may be asymmetric values based on preset ratio information. In addition, the first voltage value may be a positive value, the second voltage value may be a negative value, and an absolute value of the first voltage value may be greater than an absolute value of the second voltage value. Since the second voltage value is relatively smaller than the first voltage value, the voltage applied to the gate is reduced and insulation is easier. In addition, as the voltage applied to the gate decreases, the leakage current may also decrease.

The device of the present disclosure may sense a current output from the other side of the output terminal of the second booster circuit to the ground terminal in operation S502. To this end, the device may include a voltage sensing part, and the voltage sensing part may sense the voltage of a node between the first booster circuit and the anode and may sense a voltage of a node between the second booster circuit and the cathode. Further, according to an example embodiment, the device may control the first voltage value and the second voltage value based on voltage information sensed by the voltage sensing part.

The device of the present disclosure may control the gate voltage supplied to the gate based on the sensed current information in operation S503. To this end, the gate controlling circuit of the device may sense the current at a node between the second booster circuit and the ground terminal. The current sensed at the node between the second booster circuit and the ground terminal may be a cathode current. Alternatively, in an ideal condition, the current sensed at the node between the second booster circuit and the ground terminal may correspond to the anode current. In each of the first booster circuit and the second booster circuit, the other side of the output terminal may be connected to the ground terminal. According to an example embodiment, the voltage output from the gate power supply circuit may be a differential output voltage having electric potential difference between a positive (+) point and a negative (−) point. By controlling the gate voltage, the device of the present disclosure may control the constant current so that the current flowing through the tube is constant.

Meanwhile, in the present disclosure and drawings, example embodiments are disclosed, and certain terms are used. However, the terms are only used in general sense to easily describe the technical content of the present disclosure and to help the understanding of the present disclosure, but not to limit the scope of the present disclosure. It is apparent to those of ordinary skill in the art to which the present disclosure pertains that other modifications based on the technical spirit of the present disclosure may be implemented in addition to the example embodiments disclosed herein.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electromagnetic wave generator, comprising:

a tube comprising an anode, a cathode and at least one gate;

a tube power supply circuit in which one side of an output terminal of the tube power supply circuit is connected to the anode, and the other side of the output terminal of the tube power supply circuit is connected to the cathode; and a gate controlling circuit in which at least one side of an output terminal of the gate controlling circuit is connected to the gate, wherein a first voltage value of one side of the output terminal of the tube power supply circuit and a second voltage value of the other side of the output terminal of the tube power supply circuit are different from each other with respect to a ground terminal of the tube power supply circuit, and wherein the first voltage value and the second voltage value are determined by controlling of the tube power supply circuit.

2. The electromagnetic wave generator of claim 1, wherein the first voltage value is a positive value, and the second voltage value is a negative value, and wherein an absolute value of the first voltage value is greater than an absolute value of the second voltage value.

3. The electromagnetic wave generator of claim 1, wherein the gate controlling circuit comprises a gate power supply circuit and a pulse width modulation (PWM) control circuit configured to control the gate power supply circuit, and wherein one side of the output terminal of the gate power supply is connected to the gate, and the other side of the output terminal of the gate power supply is connected to the cathode.

4. The electromagnetic wave generator of claim 3, wherein a voltage output from the gate power supply circuit is a differential output voltage having electric potential difference between a positive point and a negative point.

5. The electromagnetic wave generator of claim 3, wherein the PWM control circuit controls the gate power supply circuit by sensing a current flowing between an output terminal of a second booster circuit of the tube power supply circuit and the ground terminal, wherein the gate power supply circuit controls a voltage value supplied to the gate based on current information sensed by the PWM control circuit, and wherein one side of the output terminal of the second booster circuit is connected to the cathode and the other side of the output terminal of the second booster circuit is connected to the ground terminal.

6. The electromagnetic wave generator of claim 1, further comprising a first voltage sensing circuit for sensing a voltage of a node between the tube power supply circuit and the anode and a second voltage sensing circuit for sensing a voltage of a node between the tube power supply circuit and the cathode, wherein the first voltage value and the second voltage value are controlled based on voltage information sensed by the first voltage sensing circuit and the second voltage sensing circuit.

7. The electromagnetic wave generator of claim 1, wherein the gate is any one of a grid structure, a wire structure and a pin-hole structure.

8. The electromagnetic wave generator of claim 1, wherein the cathode is composed of a carbon nanotube (CNT).

9. An electromagnetic wave generator, comprising:

a tube comprising an anode, a cathode and at least one gate;

a tube power supply circuit in which one side of an output terminal of the tube power supply circuit is connected to the anode, and the other side of the output terminal of the tube power supply circuit is connected to the cathode; and a gate controlling circuit in which at least one side of an output terminal of the gate controlling circuit is connected to the gate, wherein a first voltage value of one side of the output terminal of the tube power supply circuit and a second voltage value of the other side of the output terminal of the tube power supply circuit are different from each other with respect to a ground terminal of the tube power supply circuit, wherein the first voltage value and the second voltage value are determined by controlling of the tube power supply circuit, wherein the tube power supply circuit comprises a first booster circuit in which one side of the output terminal of the first booster circuit is connected to the anode, and a second booster circuit in which one side of the output terminal of the second booster circuit is connected to the cathode, and wherein the other side of the output terminal of the first booster circuit and the other side of the output terminal of the second booster circuit are connected to each other by the ground terminal.

10. A method of controlling an electromagnetic wave generator, wherein the electromagnetic wave generator comprises a tube comprising an anode, a cathode and at least one gate, a first booster circuit in which one side of an output terminal of the first booster circuit is connected to the anode and a second booster circuit in which one side of an output terminal of the second booster circuit is connected to the cathode, the method comprising:

controlling the first booster circuit and the second booster circuit such that a first voltage value of one side of the output terminal of the first booster circuit is different from a second voltage value of one side of the output terminal of the second booster circuit;

sensing a current output from the other side of the output terminal of the second booster circuit to a ground terminal; and controlling a gate voltage supplied to the gate based on sensed information on the current.

* * * * *